US008698419B2

(12) United States Patent
Yan et al.

(10) Patent No.: US 8,698,419 B2
(45) Date of Patent: Apr. 15, 2014

(54) CIRCUITS AND METHODS FOR DRIVING LIGHT SOURCES

(75) Inventors: Tiesheng Yan, Chengdu (CN); Ching-Chuan Kuo, Taipei (TW); Feng Lin, Chengdu (CN); Jianping Xu, Chengdu (CN)

(73) Assignee: O2Micro, Inc., Santa Clara, CA (US)

( * ) Notice: Subject to any disclaimer, the term of this patent is extended or adjusted under 35 U.S.C. 154(b) by 25 days.

(21) Appl. No.: 13/371,351

(22) Filed: Feb. 10, 2012

(65) Prior Publication Data

US 2012/0139433 A1 Jun. 7, 2012

Related U.S. Application Data

(63) Continuation-in-part of application No. 12/761,681, filed on Apr. 16, 2010, now Pat. No. 8,339,063.

(30) Foreign Application Priority Data

Mar. 4, 2010 (CN) ..... 2010 1 0119888
Dec. 29, 2011 (CN) ..... 2011 1 0453588

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 41/282*** | (2006.01) |

(52) U.S. Cl.

CPC ..... *H05B 41/2821* (2013.01); *H05B 41/2822* (2013.01); *H05B 37/02* (2013.01)

USPC ..... 315/302; 315/294; 315/307; 315/308

(58) Field of Classification Search

None

See application file for complete search history.

(56) References Cited

U.S. PATENT DOCUMENTS

| | | | |
|---|---|---|---|
| 5,691,605 | A | 11/1997 | Xia et al. |
| 5,959,443 | A | 9/1999 | Littlefield |
| 6,304,464 | B1 | 10/2001 | Jacobs et al. |
| 6,320,330 | B1 | 11/2001 | Haavisto et al. |

(Continued)

FOREIGN PATENT DOCUMENTS

| | | | |
|---|---|---|---|
| CN | 1498055 | A | 5/2004 |
| CN | 1694597 | A | 11/2005 |

(Continued)

OTHER PUBLICATIONS

The datasheet describes an universal high brightness LED driver HV9910B from Supertex Inc.

The datasheet describes a PWM high efficiency LED driver controller A704 from ADDtek Corp., Aug. 2008.

English translation of Abstract for CN101466186A.

English translation of Abstract for CN101815383A.

(Continued)

*Primary Examiner* — Anh Tran

(57) ABSTRACT

A circuit for driving a light-emitting diode (LED) light source includes a converter, a saw-tooth signal generator, and a controller. The converter includes a switch which is controlled by a driving signal. The converter provides a sense signal indicating the current through said LED light source. The saw-tooth signal generator generates a saw-tooth signal based on the driving signal. The controller generates the driving signal based on signals including the saw-tooth signal and the first sense signal to adjust the current through the LED light source to a target level and to correct a power factor of the driving circuit by controlling an average current of the input current to be substantially in phase with said input voltage.

14 Claims, 14 Drawing Sheets

(56) References Cited

U.S. PATENT DOCUMENTS

| | | | | |
|---|---|---|---|---|
| 6,727,662 | B2 | 4/2004 | Konopka et al. | |
| 6,839,247 | B1 | 1/2005 | Yang et al. | |
| 6,946,819 | B2 | 9/2005 | Fagnani et al. | |
| 6,975,078 | B2 | 12/2005 | Yanai et al. | |
| 6,984,963 | B2 | 1/2006 | Pidutti et al. | |
| 7,084,582 | B2 | 8/2006 | Buonocunto | |
| 7,141,940 | B2 | 11/2006 | Ortiz | |
| 7,148,664 | B2 | 12/2006 | Takahashi et al. | |
| 7,180,274 | B2 | 2/2007 | Chen et al. | |
| 7,190,124 | B2 | 3/2007 | Kumar et al. | |
| 7,259,527 | B2 | 8/2007 | Foo | |
| 7,288,902 | B1 | 10/2007 | Melanson | |
| 7,304,464 | B2 | 12/2007 | Weng et al. | |
| 7,312,783 | B2 | 12/2007 | Oyama | |
| 7,323,828 | B2 | 1/2008 | Russell et al. | |
| 7,466,082 | B1 * | 12/2008 | Snyder et al. | 315/200 A |
| 7,639,517 | B2 | 12/2009 | Zhou et al. | |
| 7,649,325 | B2 | 1/2010 | McIntosh et al. | |
| 7,710,084 | B1 | 5/2010 | Guo | |
| 7,714,464 | B2 | 5/2010 | Tsai et al. | |
| 7,759,881 | B1 | 7/2010 | Melanson | |
| 7,800,315 | B2 | 9/2010 | Shteynberg | |
| 7,804,256 | B2 | 9/2010 | Melanson | |
| 7,852,017 | B1 | 12/2010 | Melanson | |
| 7,863,828 | B2 | 1/2011 | Melanson | |
| 7,888,922 | B2 | 2/2011 | Melanson | |
| 7,944,153 | B2 | 5/2011 | Greenfeld | |
| 8,076,867 | B2 | 12/2011 | Kuo et al. | |
| 8,085,005 | B2 | 12/2011 | Dearn | |
| 8,232,780 | B2 | 7/2012 | Uno | |
| 8,274,800 | B2 | 9/2012 | Uno et al. | |
| 8,344,657 | B2 | 1/2013 | Zhan et al. | |
| 2001/0005319 | A1 | 6/2001 | Ohishi et al. | |
| 2003/0048632 | A1 | 3/2003 | Archer | |
| 2004/0085030 | A1 | 5/2004 | Laflamme et al. | |
| 2004/0130271 | A1 | 7/2004 | Sekoguchi et al. | |
| 2005/0017691 | A1 | 1/2005 | Aradachi et al. | |
| 2006/0012997 | A1 | 1/2006 | Catalano et al. | |
| 2006/0072324 | A1 | 4/2006 | Hachiya et al. | |
| 2006/0139907 | A1 | 6/2006 | Yen | |
| 2007/0047276 | A1 | 3/2007 | Lin et al. | |
| 2007/0182347 | A1 | 8/2007 | Shteynberg et al. | |
| 2007/0210725 | A1 | 9/2007 | Marosek | |
| 2007/0262724 | A1 | 11/2007 | Mednik et al. | |
| 2008/0180075 | A1 | 7/2008 | Xie et al. | |
| 2008/0203946 | A1 | 8/2008 | Ito et al. | |
| 2008/0258641 | A1 | 10/2008 | Nakagawa et al. | |
| 2008/0258647 | A1 | 10/2008 | Scianna | |
| 2008/0278092 | A1 | 11/2008 | Lys et al. | |
| 2008/0297068 | A1 | 12/2008 | Koren et al. | |
| 2009/0167187 | A1 | 7/2009 | Kitagawa et al. | |
| 2009/0184662 | A1 | 7/2009 | Given et al. | |
| 2009/0189548 | A1 | 7/2009 | Hoffman et al. | |
| 2009/0195180 | A1 | 8/2009 | Chenetz | |
| 2009/0224686 | A1 | 9/2009 | Kunimatsu | |
| 2009/0251059 | A1 | 10/2009 | Veltman | |
| 2009/0251071 | A1 | 10/2009 | Gater et al. | |
| 2009/0295303 | A1 | 12/2009 | Pucko et al. | |
| 2009/0322254 | A1 | 12/2009 | Lin | |
| 2009/0322255 | A1 | 12/2009 | Lin | |
| 2010/0013409 | A1 | 1/2010 | Quek et al. | |
| 2010/0141177 | A1 | 6/2010 | Negrete et al. | |
| 2010/0148681 | A1 | 6/2010 | Kuo et al. | |
| 2010/0219766 | A1 | 9/2010 | Kuo et al. | |
| 2010/0308733 | A1 | 12/2010 | Shao | |
| 2011/0001766 | A1 | 1/2011 | Hua et al. | |
| 2011/0013437 | A1 | 1/2011 | Uruno et al. | |
| 2011/0037399 | A1 | 2/2011 | Hung et al. | |
| 2011/0050185 | A1 | 3/2011 | Notman et al. | |
| 2011/0128303 | A1 | 6/2011 | Yonemaru et al. | |
| 2011/0133665 | A1 | 6/2011 | Huang | |
| 2011/0140620 | A1 | 6/2011 | Lin et al. | |
| 2011/0140630 | A1 | 6/2011 | Doudousakis et al. | |
| 2011/0227506 | A1 | 9/2011 | Ren et al. | |
| 2011/0285307 | A1 | 11/2011 | Kimura et al. | |
| 2011/0298374 | A1 | 12/2011 | Lenk et al. | |
| 2012/0081018 | A1 | 4/2012 | Shteynberg et al. | |
| 2012/0081029 | A1 | 4/2012 | Choi et al. | |
| 2012/0146532 | A1 | 6/2012 | Ivey et al. | |
| 2012/0217894 | A1 * | 8/2012 | Chang et al. | 315/265 |
| 2012/0242247 | A1 | 9/2012 | Hartmann et al. | |
| 2012/0293087 | A1 | 11/2012 | Matsuda et al. | |
| 2013/0033197 | A1 | 2/2013 | Hwang et al. | |

FOREIGN PATENT DOCUMENTS

| | | | |
|---|---|---|---|
| CN | 1760721 | A | 4/2006 |
| CN | 101176386 | A | 5/2008 |
| CN | 101179879 | A | 5/2008 |
| CN | 101193486 | A | 6/2008 |
| CN | 101222800 | A | 7/2008 |
| CN | 101242143 | A | 8/2008 |
| CN | 101370335 | A | 2/2009 |
| CN | 101378207 | A | 3/2009 |
| CN | 101466186 | A | 6/2009 |
| CN | 101472368 | A | 7/2009 |
| CN | 101489335 | A | 7/2009 |
| CN | 101500354 | A | 8/2009 |
| CN | 101511136 | A | 8/2009 |
| CN | 101572974 | A | 11/2009 |
| CN | 101605413 | A | 12/2009 |
| CN | 101605416 | A | 12/2009 |
| CN | 201491339 | U | 5/2010 |
| CN | 101742771 | A | 6/2010 |
| CN | 101801129 | A | 8/2010 |
| CN | 101815383 | A | 8/2010 |
| CN | 101854759 | A | 10/2010 |
| CN | 201611973 | U | 10/2010 |
| CN | 201682668 | U | 12/2010 |
| CN | 101998726 | A | 3/2011 |
| CN | 102056378 | A | 5/2011 |
| CN | 102118906 | A | 7/2011 |
| CN | 202050564 | U | 11/2011 |
| DE | 29904988 | U1 | 6/1999 |
| EP | 1565042 | A2 | 8/2005 |
| EP | 2026634 | A1 | 2/2009 |
| EP | 2031942 | A2 | 3/2009 |
| EP | 2214457 | A1 | 8/2010 |
| EP | 2273851 | A2 | 1/2011 |
| EP | 2320710 | A1 | 5/2011 |
| EP | 2533606 | A1 | 12/2012 |
| GB | 2482371 | A | 2/2012 |
| JP | 10070846 | A | 3/1998 |
| JP | 2001185371 | A | 7/2001 |
| JP | 2001245436 | A | 9/2001 |
| JP | 2008210536 | A | 9/2008 |
| JP | 2010140823 | A | 6/2010 |
| JP | 2010140824 | A | 6/2010 |
| JP | 2010282757 | A | 12/2010 |
| JP | 2011009701 | A | 1/2011 |
| WO | 2006006085 | A1 | 1/2006 |
| WO | 2008001246 | A1 | 1/2008 |
| WO | 2010148329 | A1 | 12/2010 |
| WO | 2011048214 | A1 | 4/2011 |

OTHER PUBLICATIONS

English translation of Abstract for CN101742771A.

European search report dated Oct. 4, 2013 issued in European Patent Application No. 12161538.9 (9 pages).

Japanese Office Action dated Oct. 15, 2013 issued in Japanese Patent Application 2010-258837 (3 pages).

Datasheet of "Close Loop LED Driver with Enhanced PWM Dimming" from SUPERTEX Inc, Dec. 31, 2009, pp. 1-12, XP002714011, CA, 94089, US.

Application report of" Driving High-Current LEDs" from TEXAS INSTRUMENT, Jan. 31, 2007, pp. 1-8, XP002714012.

GB Office Action dated Jan. 14, 2013 issued in related GB patent Application No. 1313787.2 (5 pages).

European Search Report dated Dec. 11, 2013 issued in related patent Application No. 13150915.0 (5 pages).

* cited by examiner

CIRCUITS AND METHODS FOR DRIVING LIGHT SOURCES

RELATED APPLICATION

This application is a continuation-in-part of the co-pending U.S. application Ser. No. 12/761,681, titled "Circuits and Methods for Driving Light Sources," filed on Apr. 16, 2010, which itself claims priority to Chinese Patent Application No. 201010119888.2, titled "Circuits and Methods for Driving Light Sources," filed on Mar. 4, 2010, with the State Intellectual Property Office of the People's Republic of China. This application also claims priority to Chinese Patent Application No. 201110453588.2, titled "Circuit, Method and Controller for Driving LED Light Source," filed on Dec. 29, 2011, with the State Intellectual Property Office of the People's Republic of China.

BACKGROUND

FIG. 1 shows a block diagram of a conventional circuit 100 for driving a light source, e.g., a light emitting diode (LED) string 108. The circuit 100 is powered by a power source 102 which provides an input voltage VIN. The circuit 100 includes a buck converter for providing a regulated voltage VOUT to an LED string 108 under control of a controller 104. The buck converter includes a diode 114, an inductor 112, a capacitor 116, and a switch 106. A resistor 110 is coupled in series with the switch 106. When the switch 106 is turned on, the resistor 110 is coupled to the inductor 112 and the LED string 108, and can provide a feedback signal indicative of a current flowing through the inductor 112. When the switch 106 is turned off, the resistor 110 is disconnected from the inductor 112 and the LED string 108, and thus no current flows through the resistor 110.

The switch 106 is controlled by the controller 104. When the switch 106 is turned on, a current flows through the LED string 108, the inductor 112, the switch 106, and the resistor 110 to ground. The current increases due to the inductance of the inductor 112. When the current reaches a predetermined peak current level, the controller 104 turns off the switch 106. When the switch 106 is turned off, a current flows through the LED string 108, the inductor 112 and the diode 114. The controller 104 can turn on the switch 106 again after a time period. Thus, the controller 104 controls the buck converter based on the predetermined peak current level. However, the average level of the current flowing through the inductor 112 and the LED string 108 can vary with the inductance of the inductor 112, the input voltage VIN, and the voltage VOUT across the LED string 108. Therefore, the average level of the current flowing through the inductor 112 (the average current flowing through the LED string 108) may not be accurately controlled.

SUMMARY

In one embodiment, a circuit for driving a light-emitting diode (LED) light source includes a converter, a saw-tooth signal generator, and a controller. The converter includes a switch which is controlled by a driving signal. The converter provides a sense signal indicating the current through said LED light source. The saw-tooth signal generator generates a saw-tooth signal based on the driving signal. The controller generates the driving signal based on signals including the saw-tooth signal and the first sense signal to adjust the current through the LED light source to a target level and to correct a power factor of the driving circuit by controlling an average current of the input current to be substantially in phase with said input voltage.

BRIEF DESCRIPTION OF THE DRAWINGS

Features and advantages of embodiments of the claimed subject matter will become apparent as the following detailed description proceeds, and upon reference to the drawings, wherein like numerals depict like parts, and in which:

DETAILED DESCRIPTION

Reference will now be made in detail to the embodiments of the present invention. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be recognized by one of ordinary skill in the art that the present invention may be practiced without these specific details. In other instances, well known methods, procedures, components, and circuits have not been described in detail as not to unnecessarily obscure aspects of the present invention.

Embodiments in accordance with the present invention provide circuits and methods for controlling power converters that can be used to power various types of loads, for example, a light source. In one embodiment, the circuit can include a current sensor operable for monitoring a current flowing through an energy storage element, e.g., an inductor, and include a controller operable for controlling a switch coupled to the inductor so as to control an average current of the light source to a target current. The current sensor can monitor the current through the inductor when the switch is on and also when the switch is off.

Figure 2:
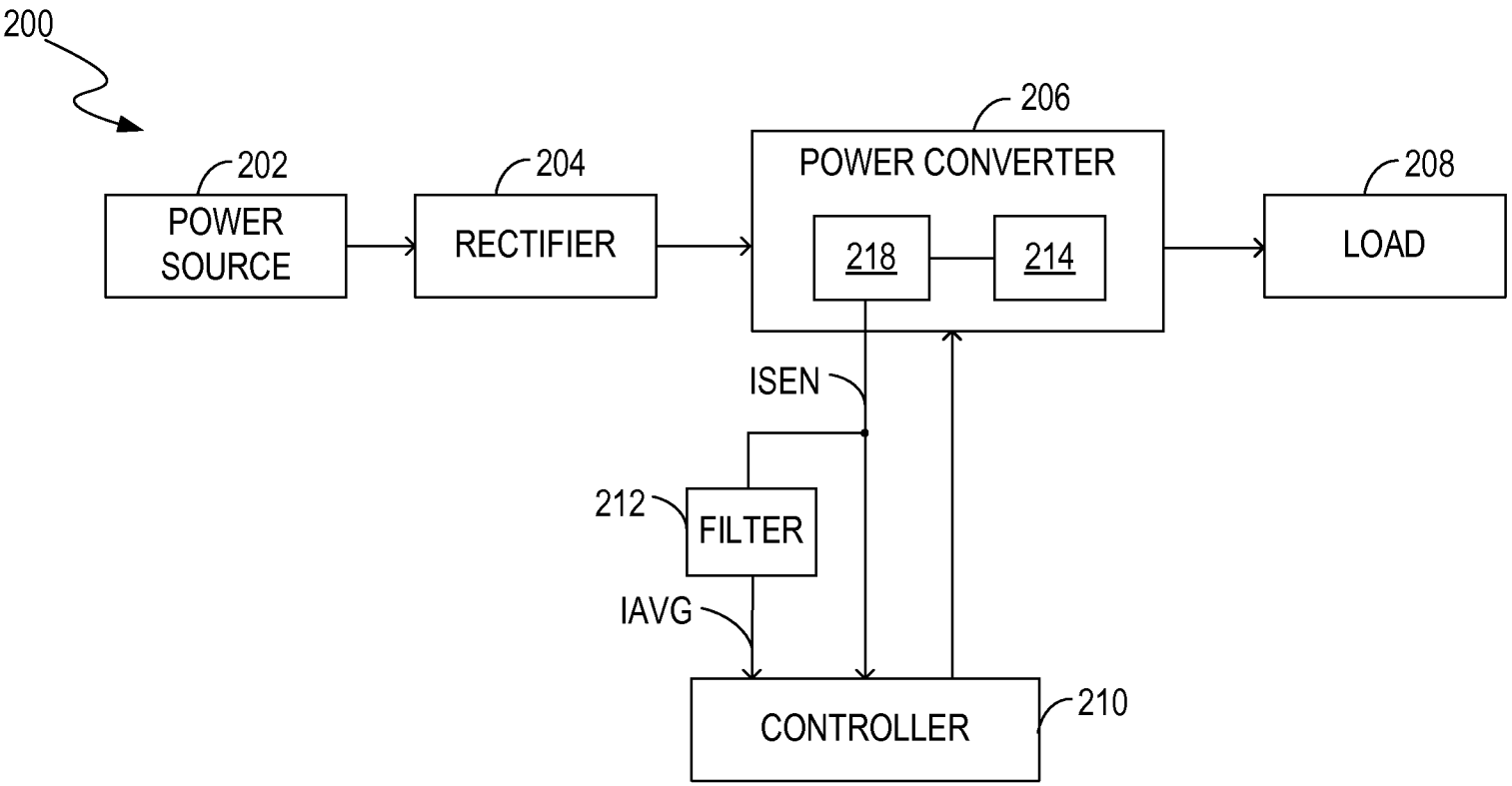
FIG. 2 shows a block diagram of a driving circuit, in accordance with one embodiment of the present invention.

FIG. 2 shows a block diagram of a driving circuit 200, in accordance with one embodiment of the present invention. The driving circuit 200 includes a rectifier 204 which receives an input voltage from a power source 202 and provides a rectified voltage to a power converter 206. The power converter 206, receiving the rectified voltage, provides output power for a load 208. The power converter 206 can be a buck converter or a boost converter. In one embodiment, the power converter 206 includes an energy storage element 214 and a current sensor 218 for sensing an electrical condition of the energy storage element 214. The current sensor 218 provides a first signal ISEN to a controller 210, which indicates an instant current flowing through the energy storage element 214. The driving circuit 200 can further include a filter 212 operable for generating a second signal IAVG based on the first signal ISEN, which indicates an average current flowing through the energy storage element 214. The controller 210 receives the first signal ISEN and the second signal IAVG, and controls the average current flowing through the energy storage element 214 to a target current level, in one embodiment.

Figure 3:
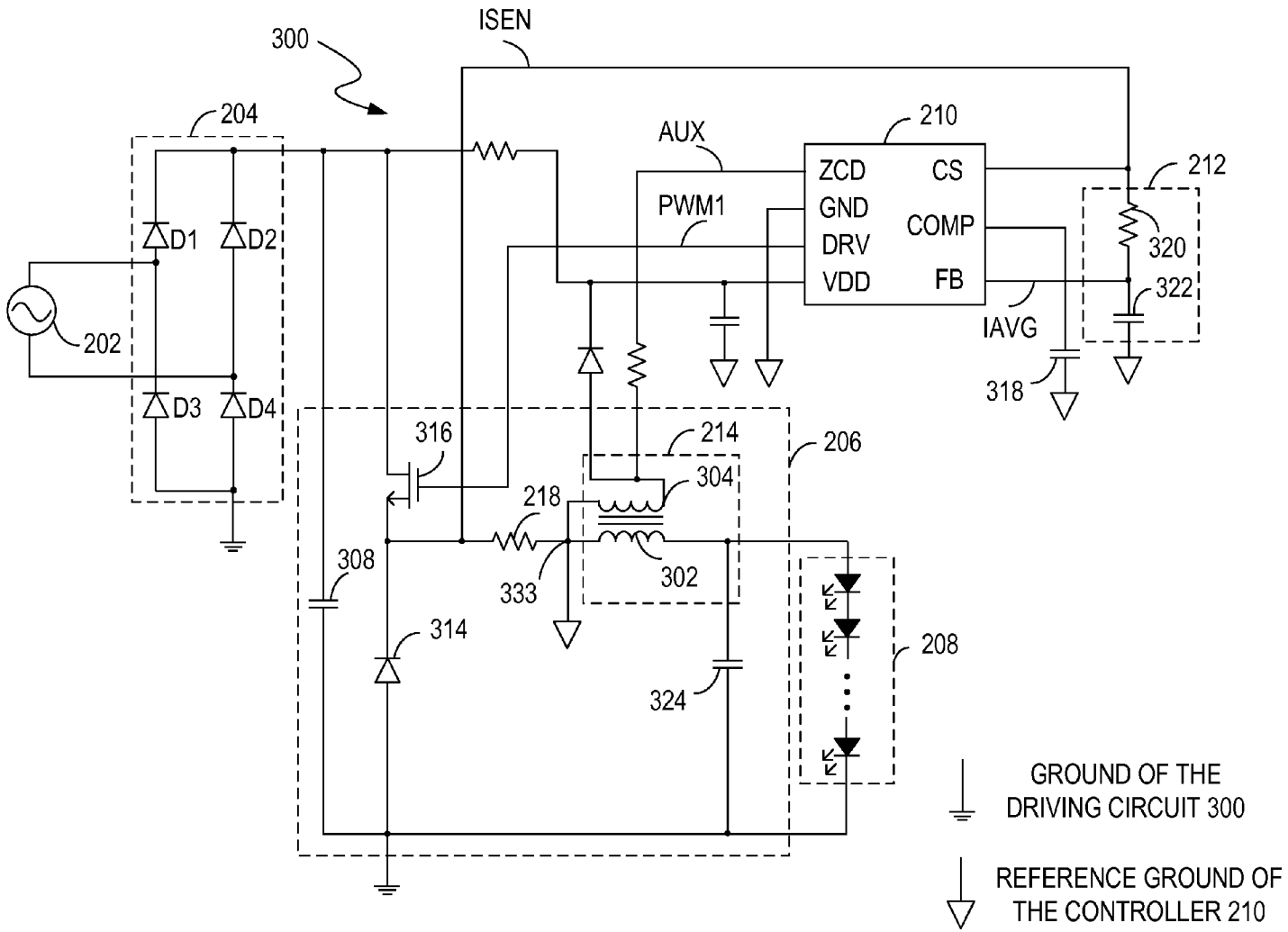
FIG. 3 shows an example for a schematic diagram of a driving circuit, in accordance with one embodiment of the present invention.

FIG. 3 shows an example for a schematic diagram of a driving circuit 300, in accordance with one embodiment of the present invention. Elements labeled the same as in FIG. 2 have similar functions. In the example of FIG. 3, the driving circuit 300 includes a rectifier 204, a power converter 206, a filter 212, and a controller 210. By way of example, the rectifier 204 is a bridge rectifier which includes diodes D1~D4. The rectifier 204 rectifies the voltage from the power source 202. The power converter 206 receives the rectified voltage from the rectifier 204 and provides output power for powering a load, e.g., an LED string 208.

In the example of FIG. 3, the power converter 206 is a buck converter including a capacitor 308, a switch 316, a diode 314, a current sensor 218 (e.g., a resistor), coupled inductors 302 and 304, and a capacitor 324. The diode 314 is coupled between the switch 316 and ground of the driving circuit 300. The capacitor 324 is coupled in parallel with the LED string 208. In one embodiment, the inductors 302 and 304 are both electrically and magnetically coupled together. More specifically, the inductor 302 and the inductor 304 are electrically coupled to a common node 333. In the example of FIG. 3, the common node 333 is between the resistor 218 and the inductor 302. However, the invention is not so limited; the common node 333 can also locate between the switch 316 and the resistor 218. The common node 333 provides a reference ground for the controller 210. The reference ground of the controller 210 is different from the ground of the driving circuit 300, in one embodiment. By turning the switch 316 on and off, a current flowing through the inductor 302 can be adjusted, thereby adjusting the power provided to the LED string 208. The inductor 304 senses an electrical condition of the inductor 302, for example, whether the current flowing through the inductor 302 decreases to a predetermined current level.

The resistor 218 has one end coupled to a node between the switch 316 and the cathode of the diode 314, and the other end coupled to the inductor 302. The resistor 218 provides a first signal ISEN indicating an instant current flowing through the inductor 302 when the switch 316 is on and also when the switch 316 is off. In other words, the resistor 218 can sense the instant current flowing through the inductor 302 regardless of whether the switch 316 is on or off. The filter 212 coupled to the resistor 218 generates a second signal IAVG indicating an average current flowing through the inductor 302. In one embodiment, the filter 212 includes a resistor 320 and a capacitor 322.

The controller 210 receives the first signal ISEN and the second signal IAVG, and controls an average current flowing through the inductor 302 to a target current level by turning the switch 316 on and off. A capacitor 324 absorbs ripple current flowing through the LED string 208 such that the current flowing through the LED string 208 is smoothed and substantially equal to the average current flowing through the inductor 302. As such, the current flowing through the LED string 208 can have a level that is substantially equal to the target current level. As used herein, "substantially equal to the target current level" means that the current flowing through the LED string 208 may be slightly different from the target current level but within a range such that the current ripple caused by the non-ideality of the circuit components can be neglected and the power transferred from the inductor 304 to the controller 210 can be neglected.

In the example of FIG. 3, the controller 210 has terminals ZCD, GND, DRV, VDD, CS, COMP and FB. The terminal ZCD is coupled to the inductor 304 for receiving a detection signal AUX indicating an electrical condition of the inductor 302, for example, whether the current flowing through the inductor 302 decreases to a predetermined current level, e.g., zero. The signal AUX can also indicate whether the LED string 208 is in an open circuit condition. The terminal DRV is coupled to the switch 316 and generates a driving signal, e.g., a pulse-width modulation signal PWM1, to turn the switch 316 on and off. The terminal VDD is coupled to the inductor 304 for receiving power from the inductor 304. The terminal CS is coupled to the resistor 218 and is operable for receiving the first signal ISEN indicating an instant current flowing through the inductor 302. The terminal COMP is coupled to the reference ground of the controller 210 through a capacitor 318. The terminal FB is coupled to the resistor 218 through the filter 212 and is operable for receiving the second signal IAVG which indicates an average current flowing through the inductor 302. In the example of FIG. 3, the terminal GND, that is, the reference ground for the controller 210, is coupled to the common node 333 between the resistor 218, the inductor 302, and the inductor 304.

The switch 316 can be an N channel metal oxide semiconductor field effect transistor (NMOSFET). The conductance status of the switch 316 is determined based on a difference between the gate voltage of the switch 316 and the voltage at the terminal GND (the voltage at the common node 333). Therefore, the switch 316 is turned on and turned off depending upon the pulse-width modulation signal PWM1 from the terminal DRV. When the switch 316 is on, the reference ground of the controller 210 is higher than the ground of the driving circuit 300, making the invention suitable for power sources having relatively high voltages.

In operation, when the switch 316 is turned on, a current flows through the switch 316, the resistor 218, the inductor 302, the LED string 208 to the ground of the driving circuit 300. When the switch 316 is turned off, a current continues to flow through the resistor 218, the inductor 302, the LED string 208 and the diode 314. The inductor 304 magnetically coupled to the inductor 302 detects an electrical condition of the inductor 302, for example, whether the current flowing through the inductor 302 decreases to a predetermined current level. Therefore, the controller 210 monitors the current flowing through the inductor 302 through the signal AUX, the signal ISEN, and the signal IAVG, and control the switch 316 by a pulse-width modulation signal PWM1 so as to control an average current flowing through the inductor 302 to a target current level, in one embodiment. As such, the current flowing through the LED string 208, which is filtered by the capacitor 324, can also be substantially equal to the target current level.

In one embodiment, the controller 210 determines whether the LED string 208 is in an open circuit condition based on the signal AUX. If the LED string 208 is open, the voltage across the capacitor 324 increases. When the switch 316 is off, the voltage across the inductor 302 increases and the voltage of the signal AUX increases accordingly. As a result, the current flowing through the terminal ZCD into the controller 210 increases. Therefore, the controller 210 monitors the signal AUX and if the current flowing into the controller 210 increases above a current threshold when the switch 316 is off, the controller 210 determines that the LED string 208 is in an open circuit condition.

The controller 210 can also determine whether the LED string 208 is in a short circuit condition based on the voltage at the terminal VDD. If the LED string 208 is in a short circuit condition, when the switch 316 is off, the voltage across the inductor 302 decreases because both terminals of the inductor 302 are coupled to ground of the driving circuit 300. The voltage across the inductor 304 and the voltage at the terminal VDD decrease accordingly. If the voltage at the terminal VDD decreases below a voltage threshold when the switch 316 is off, the controller 210 determines that the LED string 208 is in a short circuit condition.

Figure 4:
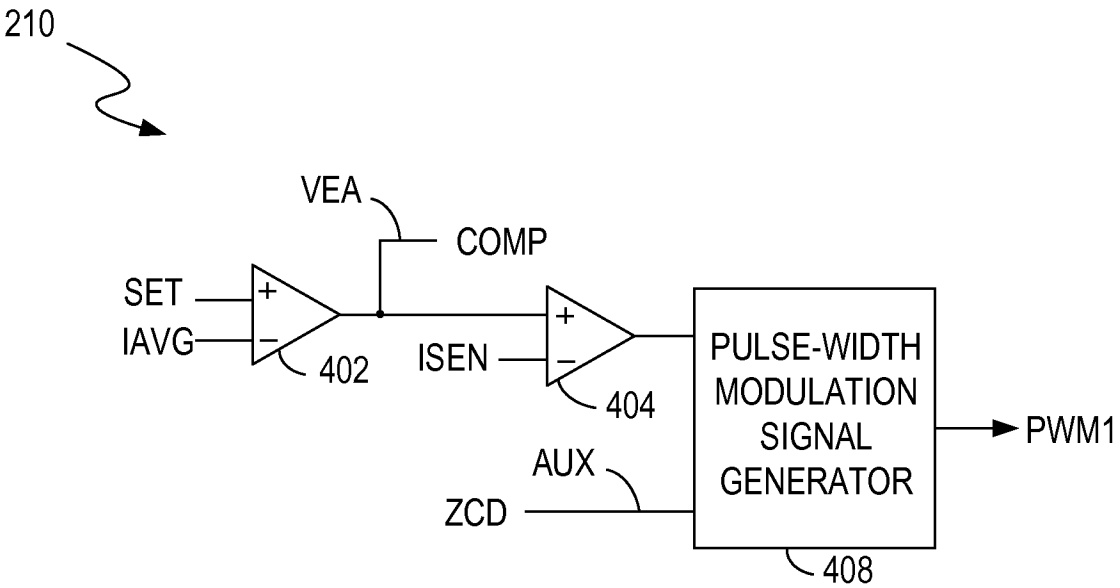
FIG. 4 shows an example of the controller in FIG. 3, in accordance with one embodiment of the present invention.
Figure 5:
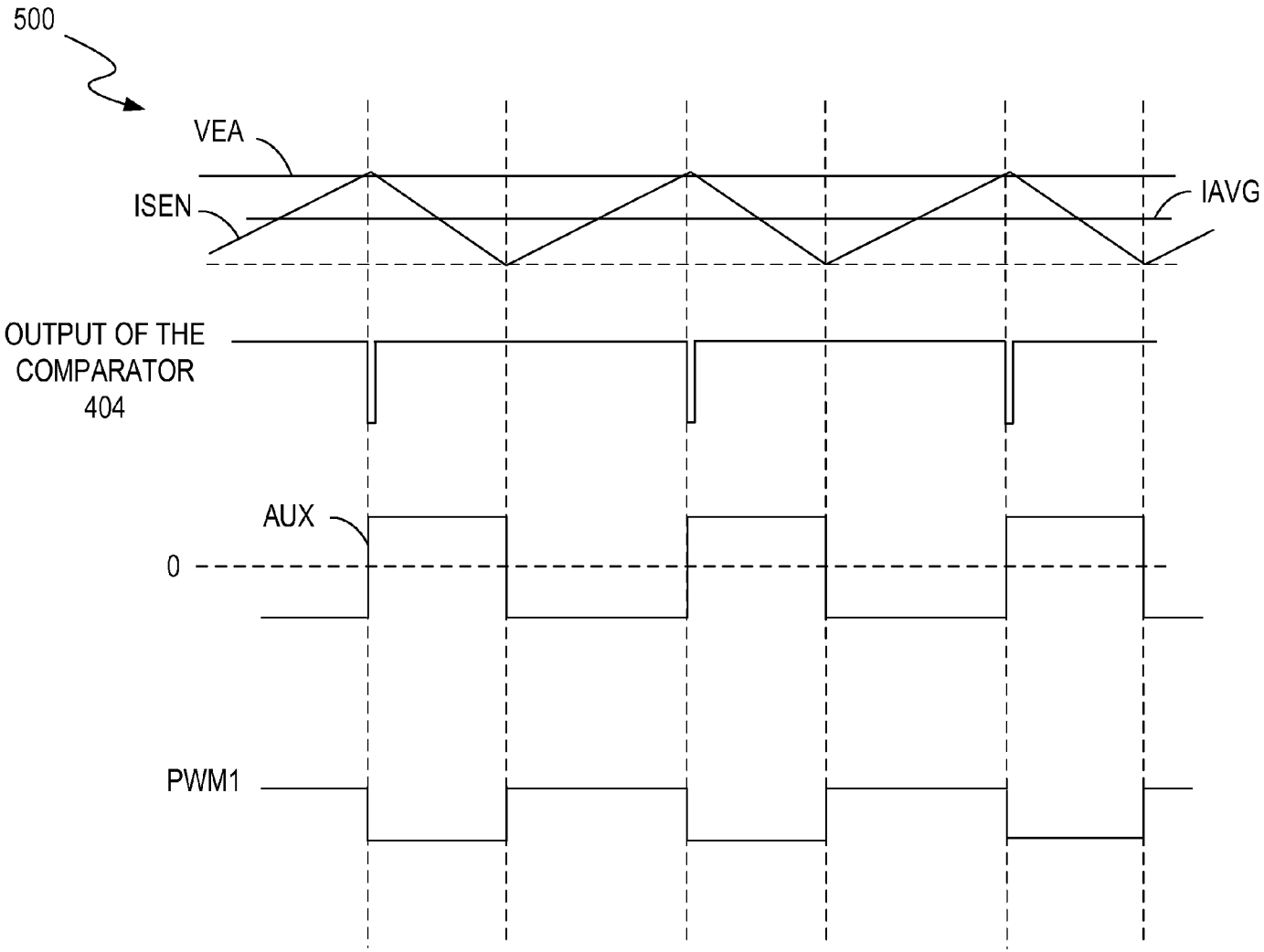
FIG. 5 shows signal waveforms of signals associated with a controller in FIG. 4, in accordance with one embodiment of the present invention.

FIG. 4 shows an example of the controller 210 in FIG. 3, in accordance with one embodiment of the present invention. FIG. 5 shows signal waveforms of signals associated with the controller 210 in FIG. 4, in accordance with one embodiment of the present invention. FIG. 4 is described in combination with FIG. 3 and FIG. 5.

In the example of FIG. 4, the controller 210 includes an error amplifier 402, a comparator 404, and a pulse-width modulation signal generator 408. The error amplifier 402 generates an error signal VEA based on a difference between a reference signal SET and the signal IAVG. The reference signal SET can indicate a target current level. The signal IAVG is received at the terminal FB and can indicate an average current flowing through the inductor 302. The error signal VEA can be used to adjust the average current flowing through the inductor 302 to the target current level. The comparator 404 is coupled to the error amplifier 402 and compares the error signal VEA with the signal ISEN. The signal ISEN is received at the terminal CS and indicates an instant current flowing through the inductor 302. The signal AUX is received at the terminal ZCD and indicates whether the current flowing through the inductor 302 decreases to a predetermined current level, e.g., zero. The pulse-width modulation signal generator 408 is coupled to the comparator 404 and the terminal ZCD, and can generate a pulse-width modulation signal PWM1 based on an output of the comparator 404 and the signal AUX. The pulse-width modulation signal PWM1 is applied to the switch 316 via the terminal DRV to control a conductance status of the switch 316.

In operation, the pulse-width modulation signal generator 408 can generate the pulse-width modulation signal PWM1 having a first level (e.g., logic 1) to turn on the switch 316. When the switch 316 is turned on, a current flows through the switch 316, the resistor 218, the inductor 302, the LED string 208 to the ground of the driving circuit 300. The current flowing through the inductor 302 increases such that the voltage of the signal ISEN increases. The signal AUX has a negative voltage level when the switch 316 is turned on, in one embodiment. In the controller 210, the comparator 404 compares the error signal VEA with the signal ISEN. When the voltage of the signal ISEN increases above the voltage of the error signal VEA, the output of the comparator 404 is logic 0, otherwise the output of the comparator 404 is logic 1, in one embodiment. In other words, the output of the comparator 404 includes a series of pulses. The pulse-width modulation signal generator 408 generates the pulse-width modulation signal PWM1 having a second level (e.g., logic 0) in response to a negative-going edge of the output of the comparator 404 to turn off the switch 316. The voltage of the signal AUX changes to a positive voltage level when the switch 316 is turned off. When the switch 316 is turned off, a current flows through the resistor 218, the inductor 302, the LED string 208 and the diode 314. The current flowing through the inductor 302 decreases such that the voltage of the signal ISEN decreases. When the current flowing through the inductor 302 decreases to a predetermined current level (e.g., zero), a negative-going edge occurs to the voltage of the signal AUX. Receiving a negative-going edge of the signal AUX, the pulse-width modulation signal generator 408 generates the pulse-width modulation signal PWM1 having the first level (e.g., logic 1) to turn on the switch 316.

In one embodiment, a duty cycle of the pulse-width modulation signal PWM1 is determined by the error signal VEA. If the voltage of the signal IAVG is less than the voltage of the signal SET, the error amplifier 402 increases the voltage of the error signal VEA so as to increase the duty cycle of the pulse-width modulation signal PWM1. Accordingly, the average current flowing through the inductor 302 increases until the voltage of the signal IAVG reaches the voltage of the signal SET. If the voltage of the signal IAVG is greater than the voltage of the signal SET, the error amplifier 402 decreases the voltage of the error signal VEA so as to decrease the duty cycle of the pulse-width modulation signal PWM1. Accordingly, the average current flowing through the inductor 302 decreases until the voltage of the signal IAVG drops to the voltage of the signal SET. As such, the average current flowing through the inductor 302 can be maintained to be substantially equal to the target current level.

Figure 6:
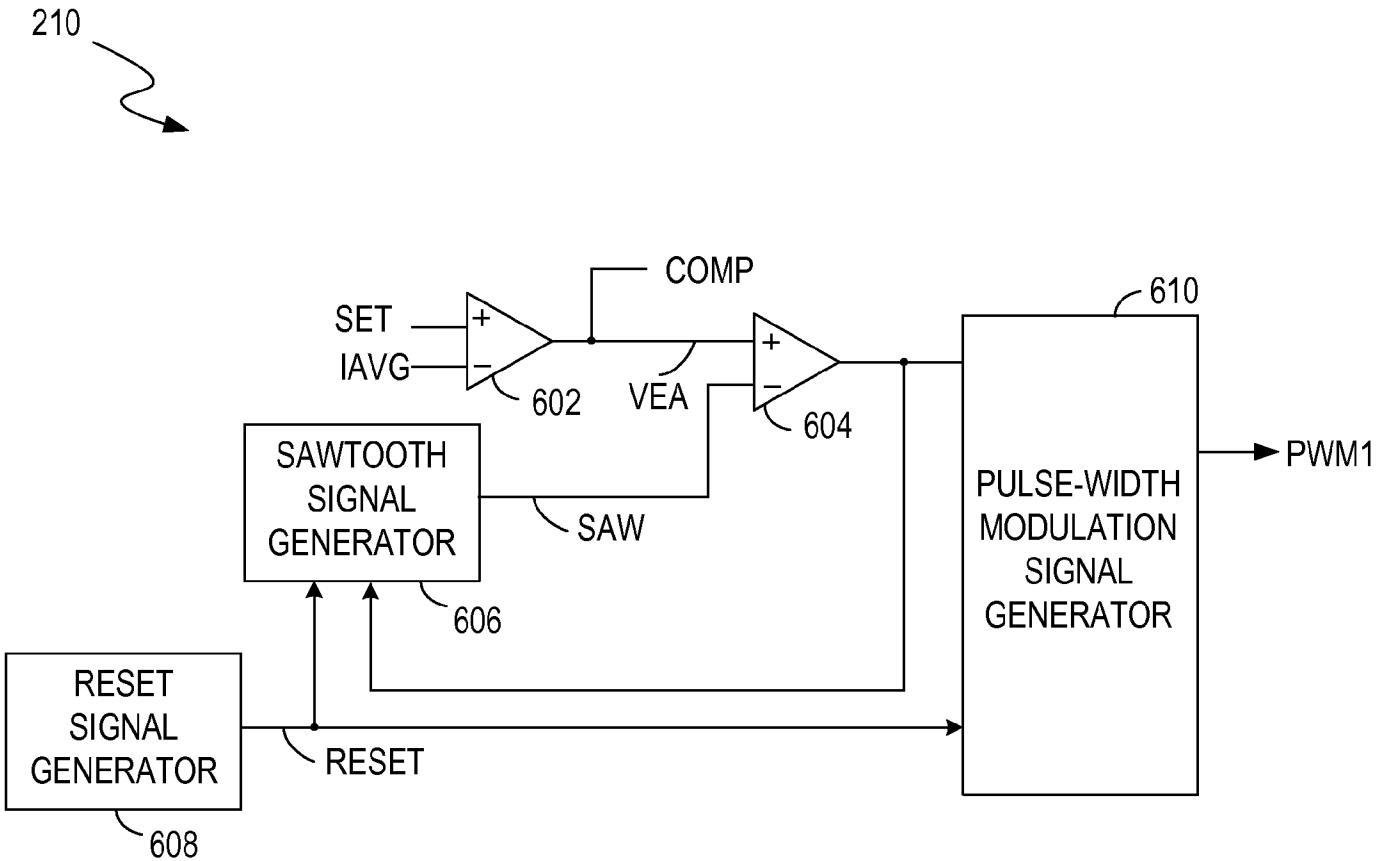
FIG. 6 shows another example of the controller in FIG. 3, in accordance with one embodiment of the present invention.
Figure 7:
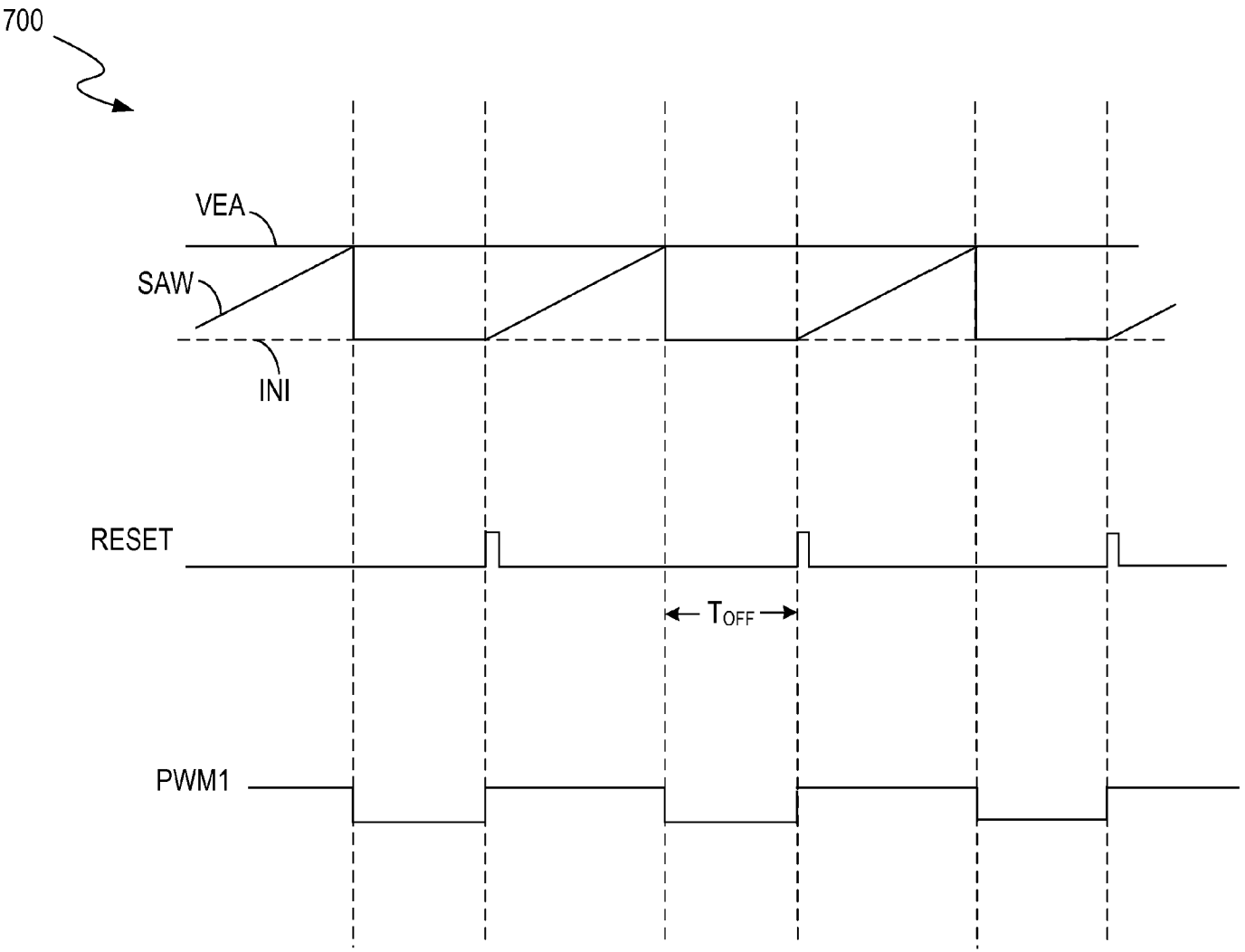
FIG. 7 shows signal waveforms of signals associated with a controller in FIG. 6, in accordance with one embodiment of the present invention.

FIG. 6 shows another example of the controller 210 in FIG. 3, in accordance with one embodiment of the present invention. FIG. 7 shows waveforms of signals associated with the controller 210 in FIG. 6, in accordance with one embodiment of the present invention. FIG. 6 is described in combination with FIG. 3 and FIG. 7.

In the example of FIG. 6, the controller 210 includes an error amplifier 602, a comparator 604, a saw-tooth signal generator 606, a reset signal generator 608, and a pulse-width modulation signal generator 610. The error amplifier 602 generates an error signal VEA based on a reference signal SET and the signal IAVG. The reference signal SET indicates a target current level. The signal IAVG is received at the terminal FB and indicates an average current flowing through the inductor 302. The error signal VEA is used to adjust the average current flowing through the inductor 302 to the target current level. The saw-tooth signal generator 606 generates a saw-tooth signal SAW. The comparator 604 is coupled to the error amplifier 602 and the saw-tooth signal generator 606, and compares the error signal VEA with the saw-tooth signal SAW. The reset signal generator 608 generates a reset signal RESET which is applied to the saw-tooth signal generator 606 and the pulse-width modulation signal generator 610. The switch 316 can be turned on in response to the reset signal RESET. The pulse-width modulation signal generator 610 is coupled to the comparator 604 and the reset signal generator 608, and generates a pulse-width modulation (PWM) signal PWM1 based on an output of the comparator 604 and the reset signal RESET. The pulse-width modulation signal PWM1 is applied to the switch 316 via the terminal DRV to control a conductance status of the switch 316.

In one embodiment, the reset signal RESET is a pulse signal having a constant frequency. In another embodiment, the reset signal RESET is a pulse signal configured in a way such that a time period Toff during which the switch 316 is off is constant. For example, in FIG. 5, the time period during which the pulse-width modulation signal PWM1 is logic 0 can be constant.

In operation, the pulse-width modulation signal generator 610 generates the pulse-width modulation signal PWM1 having a first level (e.g., logic 1) to turn on the switch 316 in response to a pulse of the reset signal RESET. When the switch 316 is turned on, a current flows through the switch 316, the resistor 218, the inductor 302, the LED string 208 to the ground of the driving circuit 300. The saw-tooth signal SAW generated by the saw-tooth signal generator 606 starts to increase from an initial level INI in response to a pulse of the reset signal RESET. When the voltage of the saw-tooth signal SAW increases to the voltage of the error signal VEA, the pulse-width modulation signal generator 610 generates the pulse-width modulation signal PWM1 having a second level (e.g., logic 0) to turn off the switch 316. The saw-tooth signal SAW is reset to the initial level INI until a next pulse of the reset signal RESET is received by the saw-tooth signal generator 606. The saw-tooth signal SAW starts to increase from the initial level INI again in response to the next pulse.

In one embodiment, a duty cycle of the pulse-width modulation signal PWM1 is determined by the error signal VEA. If the voltage of the signal IAVG is less than the voltage of the signal SET, the error amplifier 602 increases the voltage of the error signal VEA so as to increase the duty cycle of the pulse-width modulation signal PWM1. Accordingly, the average current flowing through the inductor 302 increases until the voltage of the signal IAVG reaches the voltage of the signal SET. If the voltage of the signal IAVG is greater than the voltage of the signal SET, the error amplifier 602 decreases the voltage of the error signal VEA so as to decrease the duty cycle of the pulse-width modulation signal PWM1. Accordingly, the average current flowing through the inductor 302 decreases until the voltage of the signal IAVG drops to the voltage of the signal SET. As such, the average current flowing through the inductor 302 can be maintained to be substantially equal to the target current level.

Figure 8:
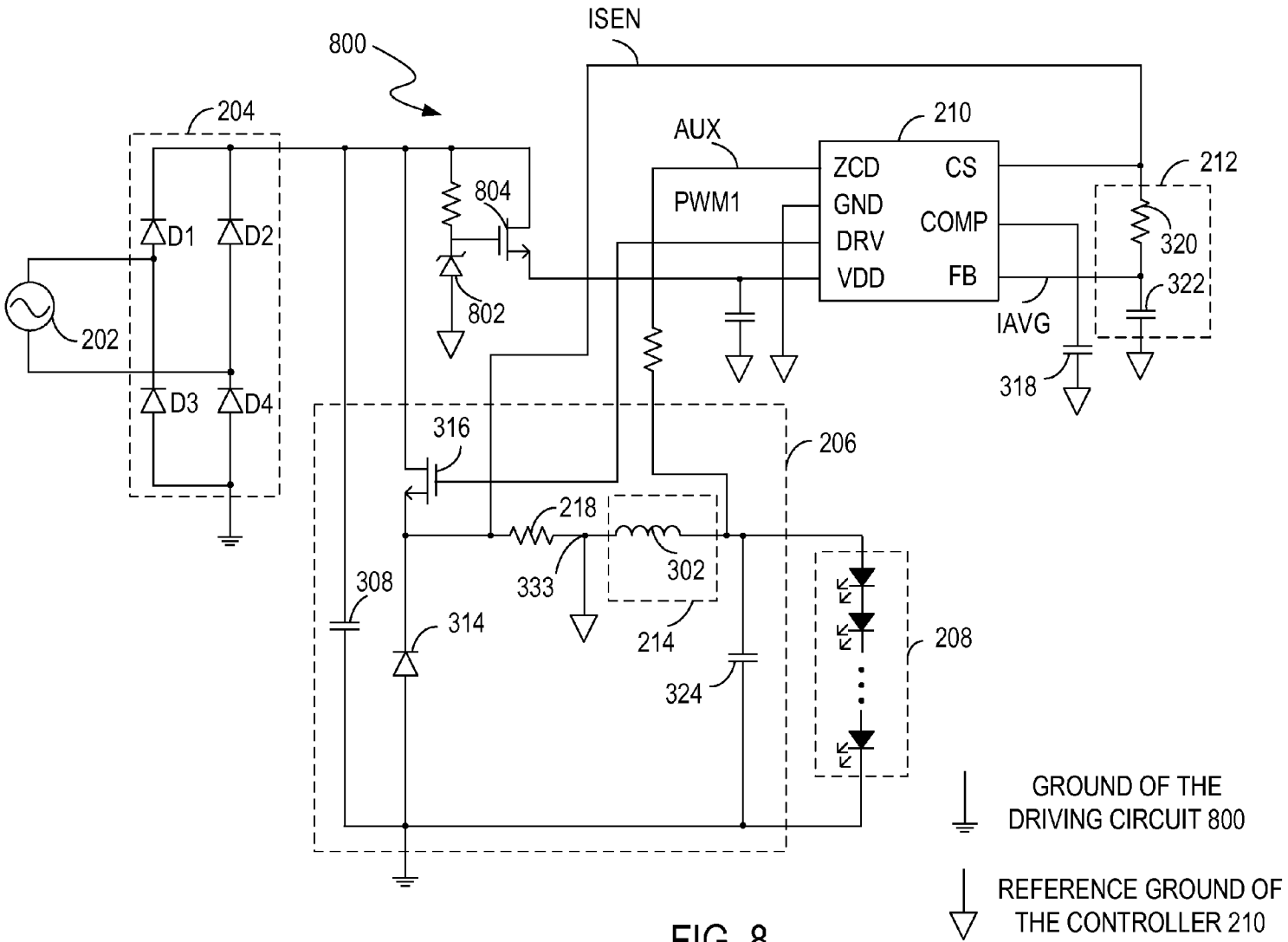
FIG. 8 shows another example for a schematic diagram of a driving circuit, in accordance with one embodiment of the present invention.

FIG. 8 shows another example for a schematic diagram of a driving circuit 800, in accordance with one embodiment of the present invention. Elements labeled the same as in FIG. 2 and FIG. 3 have similar functions.

The terminal VDD of the controller 210 is coupled to the rectifier 204 through a switch 804 for receiving the rectified voltage from the rectifier 204. A Zener diode 802 is coupled between the switch 804 and the reference ground of the controller 210, and maintains the voltage at the terminal VDD at a substantially constant level. In the example of FIG. 8, the terminal ZCD of the controller 210 is electrically coupled to the inductor 302 for receiving a signal AUX indicating an electrical condition of the inductor 302, e.g., whether the current flowing through the inductor 302 decreases to a predetermined current level, e.g., zero. The node 333 can provide the reference ground for the controller 210.

Figure 1:
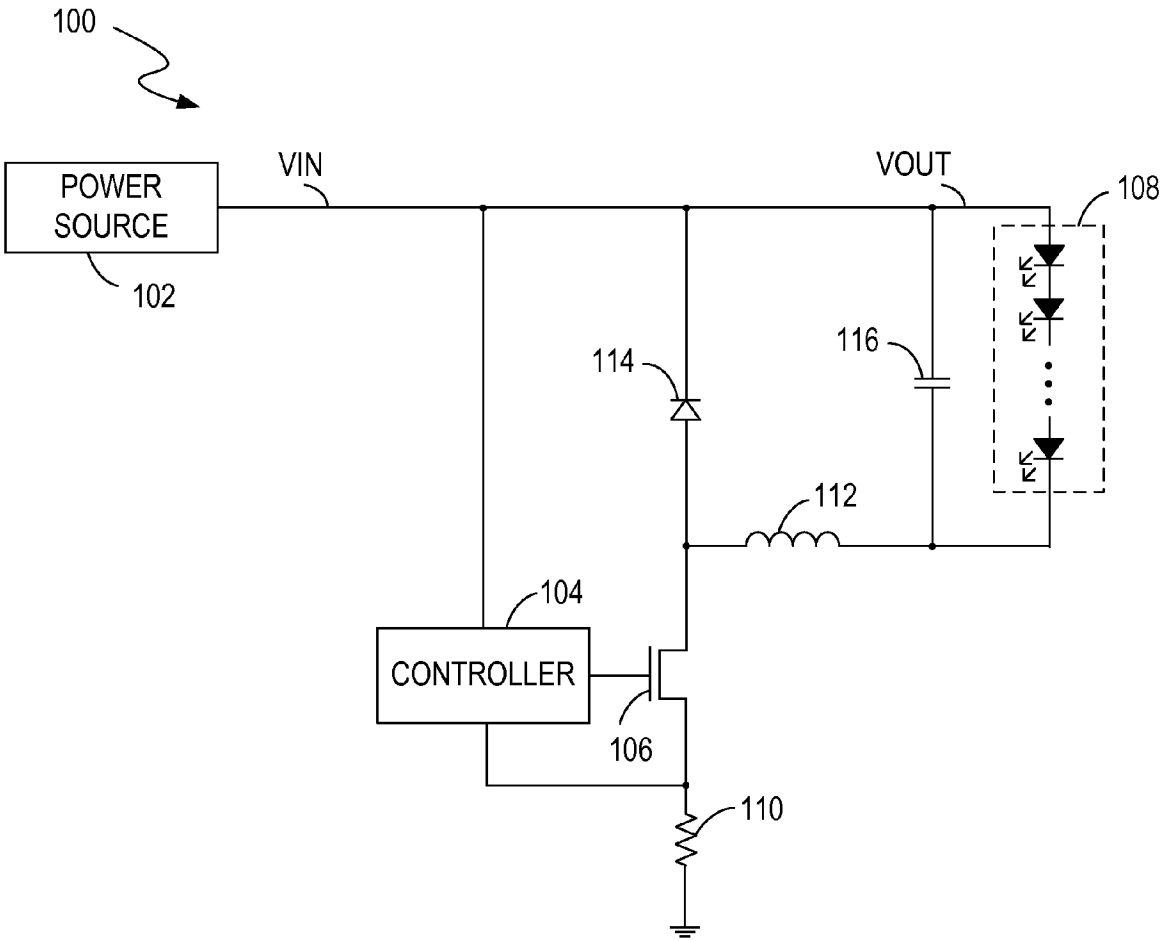
FIG. 1 PRIOR ART
FIG. 1 shows a block diagram of a conventional circuit for driving a light source.

Accordingly, embodiments in accordance with the present invention provide circuits and methods for controlling a power converter that can be used to power various types of loads. In one embodiment, the power converter provides a substantially constant current to power a load such as a light emitting diode (LED) string. In another embodiment, the power converter provides a substantially constant current to charge a battery. Advantageously, compared with the conventional driving circuit in FIG. 1, the average current to the load or the battery can be controlled more accurately. Furthermore, the circuits according to present invention can be suitable for power sources having relatively high voltages.

Figure 9A:
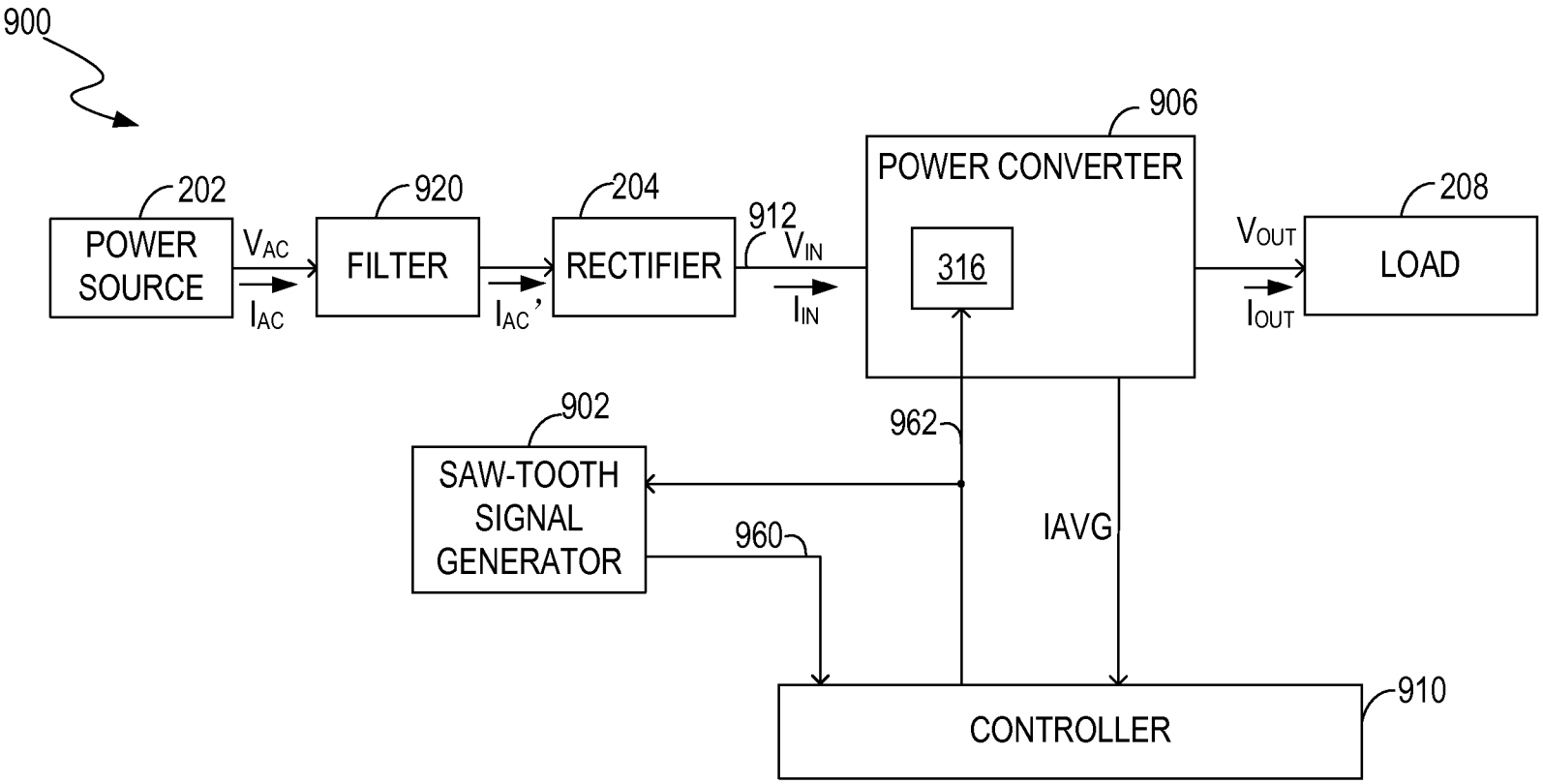
FIG. 9A shows another block diagram of a driving circuit, in accordance with one embodiment of the present invention.

FIG. 9A shows another block diagram of a driving circuit 900, in accordance with one embodiment of the present invention. Elements labeled the same as in FIG. 2 and FIG. 3 have similar functions. In the example of FIG. 9A, the driving circuit 900 includes a filter 920 coupled to a power source 202, a rectifier 204, a power converter 906, a load 208, a saw-tooth signal generator 902, and a controller 910. The power source 202 generates an AC input voltage $V_{AC}$, e.g., having a sinusoidal waveform, and an AC input current $I_{AC}$. The AC input current $I_{AC}$ flows into the filter 920 and a current $I_{AC}'$ flows from the filter 920 to the rectifier 204. The rectifier 204 receives the AC input voltage $V_{AC}$ via the filter 920 and provides a rectified AC voltage $V_{IN}$ and a rectified AC current $I_{IN}$ at the power line 912 coupled between the rectifier 204 and the power converter 906. The power converter 906 converts the voltage $V_{IN}$ to an output voltage $V_{OUT}$ to power the load 208. The controller 910 coupled to the power converter 906 controls the power converter 906 to regulate a current $I_{OUT}$ through the load 208 and correct a power factor of the driving circuit 900.

The controller 910 generates a driving signal 962. In one embodiment, the power converter 906 includes a switch 316 which is controlled by the driving signal 962. As such, a current $I_{OUT}$ flowing through the load 208 is regulated according to the driving signal 962. In on embodiment, the power converter 906 further generates a sense signal IAVG indicating the current $I_{OUT}$ through the load 208.

In one embodiment, the saw-tooth signal generator 902 coupled to the controller 910 generates a saw-tooth signal 960 according to the driving signal 962. For example, the driving signal 962 can be a pulse-width modulation (PWM) signal. In one embodiment, when the driving signal 962 is logic high, the saw-tooth signal 960 is increased; when the driving signal 962 is logic low, the saw-tooth signal 960 drops to a predetermined voltage level, e.g., zero volt.

Advantageously, the controller 910 generates the driving signal 962 based on signals including the saw-tooth signal 960 and the sense signal IAVG. The driving signal 962 controls the switch 316 to maintain the current $I_{OUT}$ through the load 208 at a target level, which improves the accuracy of the current control. In addition, the driving signal 962 controls the switch 316 to adjust an average current $I_{IN_AVG}$ of the current $I_{IN}$ to be substantially in phase with the input voltage $V_{IN}$, which corrects a power factor of the driving circuit 900. The operation of the driving circuit 900 is further described in FIG. 9B.

Figure 9B:
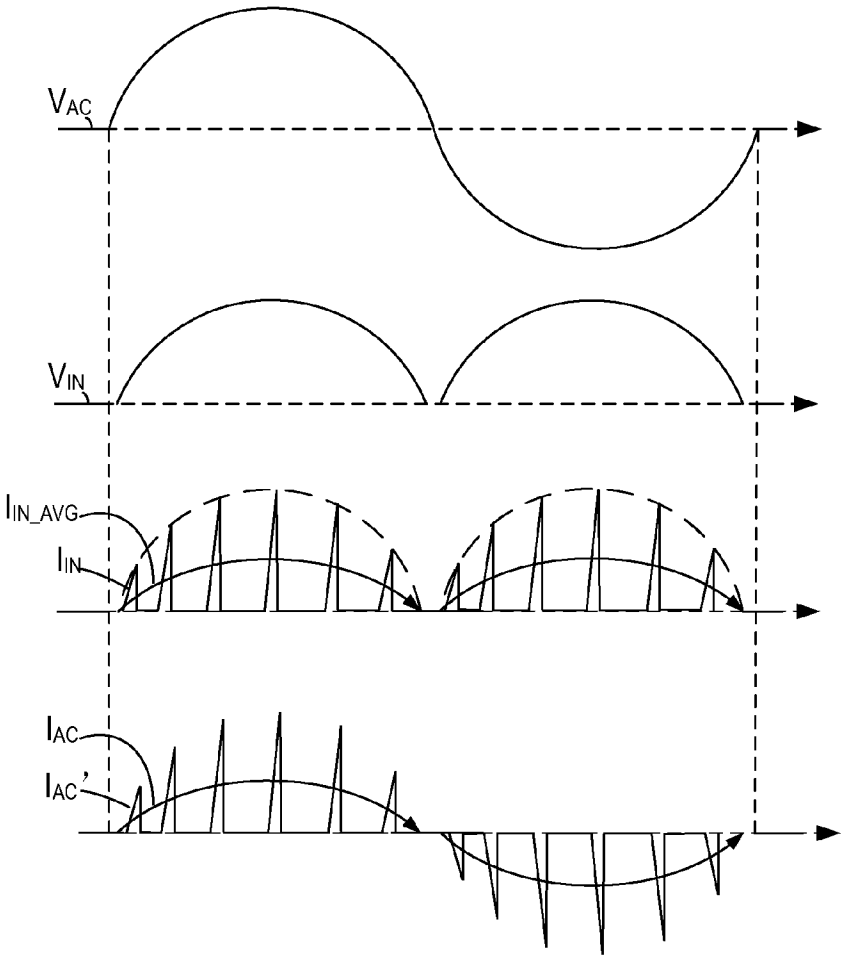
FIG. 9B shows an example of waveforms of signals generated or received by a driving circuit in FIG. 9A, in accordance with one embodiment of the present invention.

FIG. 9B shows an example of waveforms of signals associated with the driving circuit 900 in FIG. 9A, in accordance with one embodiment of the present invention. FIG. 9B is described in combination with FIG. 9A. FIG. 9B shows the input AC voltage $V_{AC}$, the rectified AC voltage $V_{IN}$, the rectified AC current $I_{IN}$, the current $I_{AC}'$, and the input AC current $I_{AC}$.

For illustrative purposes but not limitation, the input AC voltage $V_{AC}$ has a sinusoidal waveform. The rectifier 204 rectifies the input AC voltage $V_{AC}$. In the example of FIG. 9B, the rectified AC voltage $V_{IN}$ has a rectified sinusoidal waveform, in which positive waves of the input AC voltage $V_{AC}$ remains and negative waves of the input AC voltage $V_{AC}$ is converted to corresponding positive waves.

In one embodiment, the driving signal 962 generated by the controller 910 controls the current $I_{IN}$. In one embodiment, the current $I_{IN}$ increases from a predetermined level, e.g., zero ampere. After the current $I_{IN}$ reaches a level proportional to the rectified input AC voltage $V_{IN}$, the current $I_{IN}$ drops to the predetermined level. Thus, as shown in FIG. 9B, the waveform of the average current $I_{IN_AVG}$ of the current $I_{IN}$ is substantially in phase with the waveform of the rectified AC voltage $V_{IN}$.

The current $I_{IN}$ flowing from the rectifier 204 to the power converter 906 is a rectified current of the current $I_{AC}'$ flowing into the rectifier 204. As shown in FIG. 9B, the current $I_{AC}'$ has positive waves similar to those of the current $I_{IN}$ when the input AC voltage $V_{AC}$ is positive and has negative waves corresponding to those of the current $I_{IN}$ when the input AC voltage $V_{AC}$ is negative.

Figure 12:
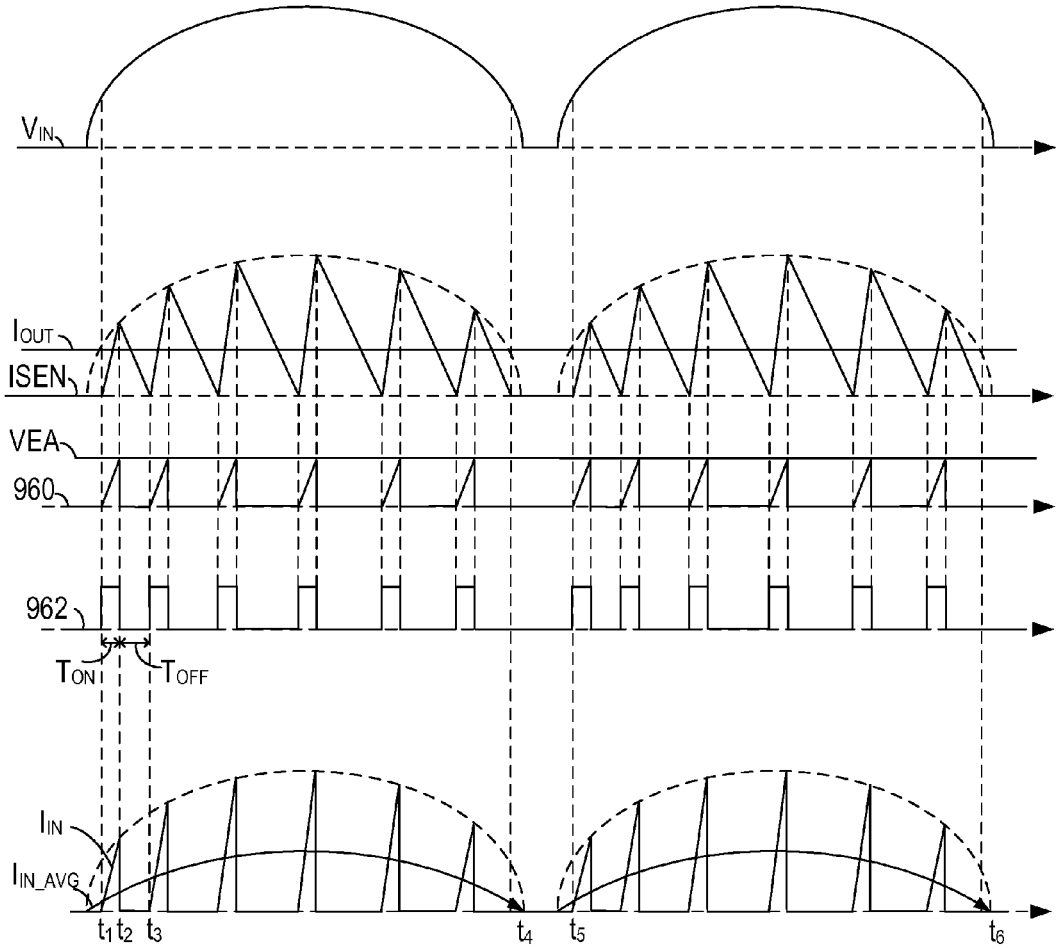
FIG. 12 illustrates a waveform of signals generated or received by a driving circuit, in accordance with one embodiment of the present invention.

In one embodiment, by employing a filter 920 between the power source 202 and the rectifier 204, the input AC current $I_{AC}$ is equal to or proportional to an average current of the current $I_{AC}'$. Therefore, as shown in FIG. 12, the waveform of the input AC current $I_{AC}$ is substantially in phase with the waveform of the input AC voltage $V_{AC}$. Ideally, the AC input voltage $V_{AC}$ and the AC input current $I_{AC}$ are in phase. However, in practical application, there might be a slight phase difference due to capacitors in the filter 920 and the power converter 906. Moreover, the shape of the waveform of the input AC current $I_{AC}$ is similar to the shape of the waveform of the input AC voltage $V_{AC}$. Therefore, a power factor of the driving circuit 900 is corrected, which improves the power quality of the driving circuit 900.

Figure 10:
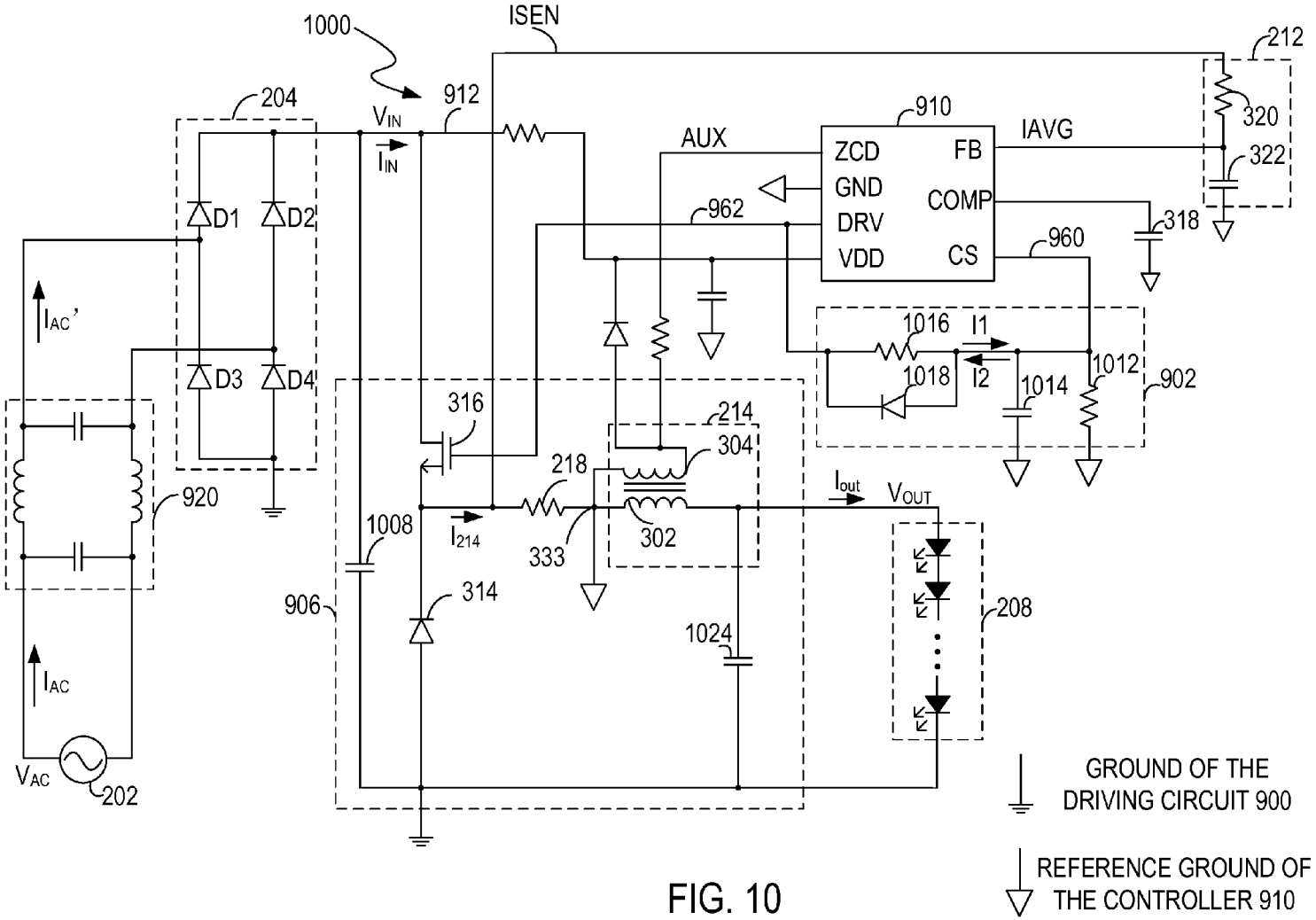
FIG. 10 shows an example for a schematic diagram of a driving circuit, in accordance with one embodiment of the present invention.

FIG. 10 shows an example for a schematic diagram of a driving circuit 1000, in accordance with one embodiment of the present invention. Elements labeled the same as in FIG. 2, FIG. 3 and FIG. 9A have similar functions. FIG. 10 is described in combination with FIG. 4, FIG. 5 and FIG. 9A.

In the example of FIG. 10, the driving circuit 1000 includes a filter 920 coupled to a power source 202, a rectifier 204, a power converter 906, a load 208, a saw-tooth signal generator 902, and a controller 910. In one embodiment, the load 208 includes an LED light source such as an LED string. This invention is not so limited; the load 208 can include other types of light sources or other types of loads such as a battery pack. The filter 920 can be, but is not limited to, an inductor-capacitor (L-C) filter including a pair of inductors and a pair of capacitors. In one embodiment, the controller 910 includes multiple terminals such as a ZCD terminal, a GND terminal, a DRV terminal, a VDD terminal, an FB terminal, a COMP terminal, and a CS terminal.

In one embodiment, the power converter 906 includes an input capacitor 1008 coupled to the power line 912. The input capacitor 1008 reduces ripples of the rectified AC voltage $V_{IN}$ to smooth the waveform of the rectified AC voltage $V_{IN}$. In one embodiment, the capacitor 1008 has a relatively small capacitance, e.g., less than 0.5 μF, to help eliminate or reduce any distortion of the rectified AC voltage $V_{IN}$. Moreover, in one embodiment, a current flowing through the capacitor 1008 can be ignored due to the relatively small capacitance. Thus, the current $I_{IN}$ flowing through the switch 316 is approximately equal to the current from the rectifier 204 when the switch 316 is on.

The power converter 906 operates similarly as the power converter 206 in FIG. 3. In one embodiment, the energy storage element 214 includes inductors 302 and 304 magnetically and electrically coupled with each other. The inductor 302 is coupled to the switch 316 and the LED light source 208. Thus, a current $I_{214}$ flows through the inductor 302 according to the conductance status of the switch 316. More specifically, in one embodiment, the controller 910 generates the driving signal 962, e.g., a PWM signal, through the DRV terminal to switch the switch 316 to an ON state or an OFF state. When the switch 316 is turned on, the current $I_{214}$ flows from the power line 912 through the switch 316 and the inductor 302. The current $I_{214}$ increases during the ON state of the switch 316, which can be given according to equation (1):

$$\Delta I_{214}=(V_{IN}-V_{OUT})*T_{ON}/L_{302}, \quad (1)$$

where $T_{ON}$ represents a time duration when the switch 316 is turned on, $\Delta I_{214}$ represents a change of the current $I_{214}$, and $L_{302}$ represents the inductance of the inductor 302. In one embodiment, the controller 920 controls the driving signal 962 to maintain the time duration $T_{ON}$ constant. Therefore, the change $\Delta I_{214}$ of the current $I_{214}$ during the time $T_{ON}$ is proportional to the input voltage $V_{IN}$ if $V_{OUT}$ is a substantially constant. In one embodiment, the switch 316 is turned on when the current $I_{214}$ decreases to a predetermined level, e.g., zero ampere. Accordingly, the peak level of the current $I_{214}$ is proportional to the input voltage $V_{IN}$.

When the switch 316 is turned off, the current $I_{214}$ flows from the ground through the diode 314 and the inductor 302 to the LED light source 208. Accordingly, the current $I_{214}$ decreases according to equation (2):

$$\Delta I_{214}=(-V_{OUT})*T_{OFF}/L_{302}. \quad (2)$$

Thus, the current $I_{IN}$ is substantially equal to the current $I_{214}$ during an ON state of the switch 316 and equal to zero ampere during an OFF state of the switch 316, in one embodiment.

The inductor 304 senses an electrical condition of the inductor 302, e.g., whether the current flowing through the inductor 302 decreases to a predetermined level (e.g., zero ampere). As discussed in relation to FIG. 5, the detection signal AUX has a negative level when the switch 316 is turned on, and has a positive level when the switch 316 is turned off, in one embodiment. When the current $I_{214}$ through the inductor 302 decreases to a predetermined current level, a negative-going edge occurs to the voltage of the signal AUX. The ZCD terminal of the controller 910 coupled to the inductor 304 is used to receive the detection signal AUX.

In one embodiment, the power converter 906 includes an output filter 1024. The output filter 1024 can be a capacitor having a relatively large capacitance, e.g., greater than 400 μF. As such, the current $I_{OUT}$ through the LED light source 208 represents an average level of the current $I_{214}$.

The current sensor 218 generates a current sense signal ISEN indicating the current flowing through the inductor 302. In one embodiment, the signal filter 212 is a resistor-capacitor (RC) filter including a resistor 320 and a capacitor 322. The signal filter 212 removes ripples of the current sense signal ISEN to generate an average sense signal IAVG of the current signal ISEN. Thus, in the example of FIG. 10, the average sense signal IAVG indicates the current $I_{OUT}$ flowing through the LED light source 208. The terminal FB of the controller 910 receives the sense signal IAVG, in one embodiment.

The saw-tooth signal generator 902 coupled to the DRV terminal and the CS terminal is operable for generating a saw-tooth signal 960 at the CS terminal according to the driving signal 962 on the DRV terminal. By way of example, the saw-tooth signal generator 902 includes a resistor 1016 and a diode 1018 coupled in parallel between the terminal DRV and the terminal CS, and further includes a resistor 1012 and a capacitor 1014 coupled in parallel between the CS terminal and ground. In operation, the saw-tooth signal 960 varies according to the driving signal 962. More specifically, in one embodiment, the driving signal 962 is a PWM signal. When the driving signal 962 is logic high, a current I1 flows from the DRV terminal through the resistor 1016 to the capacitor 1014. Thus, the capacitor 1014 is charged and a voltage $V_{960}$ of the saw-tooth signal 960 increases. When the driving signal 962 is logic low, a current I2 flows from the capacitor 1014 through the diode 1018 to the DRV terminal. Thus, the capacitor 1014 is discharged and the voltage $V_{960}$ decreases to zero volts. The saw-tooth signal generator 902 can include other components and is not limited to the example shown in FIG. 10.

In one embodiment, the controller 910 is integrated on an integrated circuit (IC) chip. The resistors 1016 and 1012, the diode 1018, and the capacitor 1014 are peripheral components to the IC chip. Alternatively, the saw-tooth signal generator 902 and the controller 910 are both integrated on a single IC chip. In this condition, the terminal CS can be removed, which further reduces the size and the cost of the driving circuit 1000. The power converter 906 can have other configurations and is not limited to the example in FIG. 10.

Figure 11:
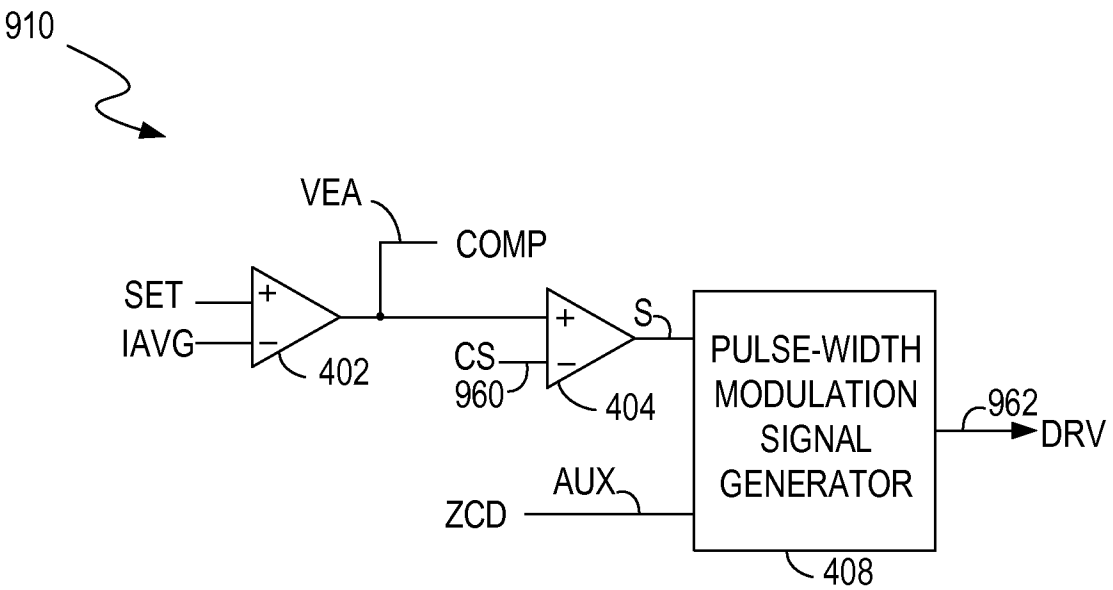
FIG. 11 shows an example of a controller in FIG. 9A, in accordance with one embodiment of the present invention.

FIG. 11 shows an example of the controller 910 in FIG. 9A, in accordance with one embodiment of the present invention. Elements labeled the same as in FIG. 4 and FIG. 9A have similar functions. FIG. 11 is described in combination with FIG. 4, FIG. 5, FIG. 9A and FIG. 10.

In one embodiment, the controller 910 has similar configurations as the controller 210 in FIG. 4, except that the CS terminal receives the saw-tooth signal 960 instead of the current sense signal ISEN. The controller 910 generates the driving signal 962 according to the signals including the saw-tooth signal 960, the sense signal IAVG, and the detection signal AUX. The controller 910 includes an error amplifier 402, a comparator 404, and a pulse-width modulation (PWM) signal generator 408. The error amplifier 402 amplifies a difference between the sense signal IAVG and a reference signal SET indicating a target current level to generate the error signal VEA. The comparator 404 compares the saw-tooth signal 960 to the error signal VEA to generate a comparing signal S. The PWM signal generator 408 generates the driving signal 962 according to the comparing signal S and the detection signal AUX.

In one embodiment, the driving signal 962 has a first level, e.g., logic high, to turn on the switch 316 when the detection signal AUX indicates that the current $I_{214}$ through the inductor 302 drops to a predetermined level, e.g., zero ampere. The driving signal 962 has a second level, e.g., logic low, to turn off the switch 316 when the saw-tooth signal 960 reaches the error signal VEA. Advantageously, since the CS terminal receives the saw-tooth signal 960 instead of the sense signal ISEN, a peak level of the current $I_{214}$ through the inductor 302 is not limited by the error signal VEA. Thus, the current $I_{214}$ through the inductor 302 varies according to the input voltage $V_{IN}$ as shown in equation (1). For example, the peak level of the current $I_{214}$ is adjusted to be proportional to the input voltage $V_{IN}$ instead of the error signal VEA.

The controller 910 controls the driving signal 962 to maintain the current $I_{OUT}$ at a target current level represented by the reference signal SET. For example, if the current $I_{OUT}$ is greater than the target level, e.g., due to the variation of the input voltage $V_{IN}$, the error amplifier 402 decreases the error signal VEA to shorten the time duration $T_{ON}$ of the ON state of the switch 316. Therefore, the average level of the current $I_{214}$ is decreased to decrease the current $I_{OUT}$. Likewise, if the current $I_{OUT}$ is less than the target level, the controller 910 lengthens the time duration $T_{ON}$ to increase the current $I_{OUT}$.

FIG. 12 illustrates a waveform of signals generated or received by a driving circuit, e.g., the driving circuit 900 or 1000, in accordance with one embodiment of the present invention. FIG. 12 is described in relation to FIG. 4, FIG. 9A, FIG. 9B, and FIG. 10. FIG. 12 shows the rectified AC voltage $V_{IN}$, the rectified AC current $I_{IN}$, the average current $I_{IN_AVG}$ of the current $I_{IN}$, the current $I_{OUT}$ flowing through the LED light source 208, the sense signal ISEN indicating the current $I_{214}$ flowing through the inductor 302, the error signal VEA, the saw-tooth signal 960, and the driving signal 962.

As shown in the example of FIG. 12, the input voltage $V_{IN}$ is a rectified sinusoidal waveform. At time t1, the driving signal 962 is changed to logic high. Thus, the switch 316 is turned on and the sense signal ISEN indicating the current $I_{214}$ through the inductor 302 increases. Meanwhile, the saw-tooth signal 960 increases according to the driving signal 962.

At time t2, the saw-tooth signal 960 reaches the error signal VEA. Accordingly, the controller 910 adjusts the driving signal 962 to logic low. The saw-tooth signal 960 drops to zero volts. The driving signal 962 turns off the switch 316, thereby decreasing the sense signal ISEN. In other words, the saw-tooth signal 960 and the error signal VEA determine the time period $T_{ON}$ when the driving signal 962 is logic high to turn on the switch 316.

At time t3, the current $I_{214}$ decreases to the predetermined current level, e.g., zero ampere. Thus, the controller 910 adjusts the driving signal 962 to logic high to turn on the switch 316.

In one embodiment, the current $I_{OUT}$ flowing through the LED light source 208 is equal to or proportional to an average level of the current $I_{214}$ over a cycle period of the input voltage $V_{IN}$. As described in relation to FIG. 11, the current $I_{OUT}$ is adjusted to the target current level represented by the reference signal SET. In addition, as shown in FIG. 12, the sense signal ISEN indicating the current $I_{214}$ between t1 and t4 has same waveforms as those between t5 and t6. Thus, the average level of the current $I_{214}$ between t1 and t4 is equal to the average level of the current $I_{214}$ between t5 and t6. Accordingly, the current $I_{OUT}$ is maintained at the target level. In one embodiment, the time period $T_{ON}$ is determined by the saw-tooth signal 960 and the error signal VEA. In one embodiment, the time period $T_{ON}$ is constant because the time period for the saw-tooth signal 960 to rise from zero volts to the error signal VEA is the same in each cycle of the driving signal 962. Based on equation (1), the change $\Delta I_{214}$ of the current $I_{214}$ during the time period $T_{ON}$ is proportional to the input voltage $V_{IN}$. Therefore, the peak level of the sense signal ISEN is proportional to the input voltage $V_{IN}$ as shown in FIG. 12.

The current $I_{IN}$ has a waveform similar to the waveform of the current $I_{214}$ when the switch 316 is turned on, and is substantially equal to zero ampere when the switch 316 is turned off, in one embodiment. The average current $I_{IN_AVG}$ is substantially in phase with the input voltage $V_{IN}$ between time t1 and t6. As described in relation to FIG. 9B, the AC input current $I_{AC}$ is substantially in phase with the AC input voltage $V_{AC}$, which corrects the power factor of the driving circuit 900 to improve the power quality.

Figure 13:
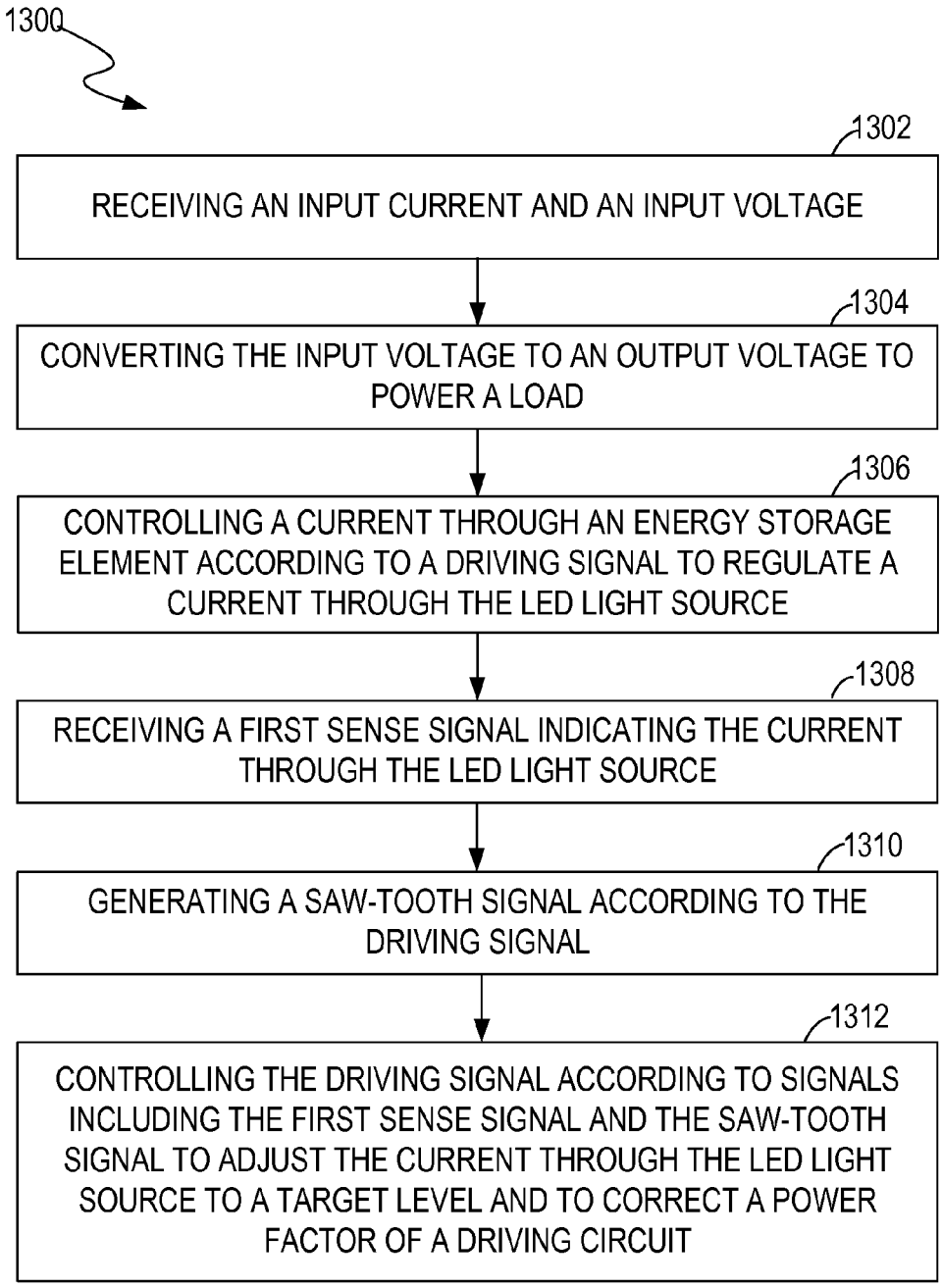
FIG. 13 illustrates a flowchart of operations performed by a circuit for driving a load, in accordance with one embodiment of the present invention.

FIG. 13 illustrates a flowchart 1300 of operations performed by a circuit for driving a load, e.g., the circuit 900 or 1000 for driving an LED light source 208, in accordance with one embodiment of the present invention. FIG. 13 is described in combination with FIG. 9A-FIG. 12. Although specific steps are disclosed in FIG. 13, such steps are examples. That is, the present invention is well suited to performing various other steps or variations of the steps recited in FIG. 13.

In block 1302, an input voltage, e.g., the rectified AC voltage $V_{IN}$, and an input current, e.g., the rectified AC current $I_{IN}$, are received. In block 1304, the input voltage is converted to an output voltage to power a load, e.g., an LED light source. In block 1306, a current flowing through an energy storage element, e.g., the energy storage element 214, is controlled according to a driving signal, e.g., the driving signal 962, so as to regulate a current through said LED light source.

In block 1308, a first sense signal, e.g., IAVG, indicating the current through said LED light source is received. In one embodiment, the first sense signal is generated by filtering a second sense signal indicating the current through the energy storage element. In block 1310, a saw-tooth signal is generated based on the driving signal.

In block 1312, the driving signal is controlled based on signals including the saw-tooth signal and the first sense signal to adjust the current through the LED light source to a target level and to correct a power factor of the driving circuit by controlling an average current of the input current to be substantially in phase with the input voltage. In one embodiment, an error signal indicating a difference between the first sense signal and a reference signal indicating the target level of the current through the LED light source is generated. The saw-tooth signal is compared to the error signal. A detection signal indicating an electric condition of the energy storage element is received. The driving signal is switched to a first state if the detection signal indicates that the current through the energy storage element decreases to a predetermined level and is switched to a second state according to a result of the comparison of the saw-tooth signal and the error signal. The current through the energy storage element is increased when the driving signal is in the first state and is decreased when the driving signal is in the second state. In one embodiment, a time duration for the saw-tooth signal to increase from a predetermined level to the error signal is constant if the current through the LED light source is maintained at the target level.

Embodiments in accordance with the present invention provide a driving circuit for driving a load, e.g., an LED light source. The driving circuit includes a power converter and a controller. The power converter converts an input voltage to an output voltage to power the load. The power converter provides a sense signal indicating a current flowing through the load. The driving circuit further includes a saw-tooth signal generator for generating a saw-tooth signal according to the driving signal. Advantageously, the controller generates a driving signal according to signals including the sense signal and the saw-tooth signal. The driving signal controls the current through the energy storage element, which further adjusts the current through the load to a target current level and corrects a power factor by controlling an AC input current to be substantially in phase with an AC input voltage of the driving circuit.

While the foregoing description and drawings represent embodiments of the present invention, it will be understood that various additions, modifications and substitutions may be made therein without departing from the spirit and scope of the principles of the present invention as defined in the accompanying claims. One skilled in the art will appreciate that the invention may be used with many modifications of form, structure, arrangement, proportions, materials, elements, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims and their legal equivalents, and not limited to the foregoing description.

What is claimed is:

1. A circuit for driving a light-emitting diode (LED) light source, said circuit comprising:

a converter operable for receiving an input voltage and an input current and powering said LED light source, that comprises a switch controlled by a driving signal, and operable for providing a first sense signal indicating a current through said LED light source;

a saw-tooth signal generator, coupled to said converter, operable for generating a saw-tooth signal based on said driving signal; and a controller, coupled to said converter and said saw-tooth signal generator, operable for generating said driving signal based on signals comprising said saw-tooth signal and said first sense signal to adjust said current through said LED light source to a target level and to correct a power factor of said driving circuit by controlling an average current of said input current to be substantially in phase with said input voltage.

2. The circuit as claimed in claim 1, wherein said converter further comprises an energy storage element, a current of which is controlled by said switch.

3. The circuit as claimed in claim 2, wherein said controller further comprises:

an error amplifier operable for generating an error signal based on said first sense signal and a reference signal indicating said target level of said current through said LED light source; and a comparator, coupled to said error amplifier, operable for comparing said saw-tooth signal with said error signal to control said driving signal, wherein said driving signal has a first state and a second state, wherein said current through said energy storage element is increased when said driving signal is in said first state, and is decreased when said driving signal is in second state.

4. The circuit as claimed in claim 3, wherein said saw-tooth signal increases during said first state of said driving signal, and wherein said driving signal is switched to said second state when said saw-tooth signal reaches said error signal.

5. The circuit as claimed in claim 3, wherein a time duration for said saw-tooth signal to increase from a predetermined level to said error signal is constant if said current through said LED light source is maintained at said target level.

6. The circuit as claimed in claim 2, wherein said controller is further operable for receiving a detection signal indicating an electrical condition of said energy storage element, wherein said driving signal has a first state and a second state, wherein said current through said energy storage element is increased when said driving signal is in said first state, and is decreased when said driving signal is in said second state, wherein said driving signal is switched to said first state if said detection signal indicates that said current through said energy storage element decreases to a predetermined level.

7. The circuit as claimed in claim 2, wherein said energy storage element comprises:

a first inductor electrically coupled to said switch and said LED light source, wherein said current of said energy storage element flows through said first inductor; and a second inductor, magnetically and electrically coupled to said first inductor, operable for generating a detection signal indicating an electrical condition of said first inductor.

8. The circuit as claimed in claim 7, wherein said first inductor and said second inductor are electrically coupled to a common node between said switch and said first inductor, wherein said common node provides a reference ground for said controller, and wherein said reference ground is different from the ground of said circuit.

9. The circuit as claimed in claim 1, wherein said saw-tooth signal generator comprises:

a diode and a first resistor coupled in parallel between a first node and a second node; and a capacitor and a second resistor coupled in parallel between said second node and ground, wherein said first node receives said driving signal, and said second node provides said saw-tooth signal.

10. The circuit as claimed in claim 1, further comprising:

a rectifier operable for receiving an input alternating current (AC) current and an input AC voltage and providing said input current, wherein said controller is operable for correcting said power factor such that said input AC current is substantially in phase with said input AC voltage.

11. A method for powering a light-emitting diode (LED) light source, said method comprising:

receiving an input voltage and an input current;

converting said input voltage to an output voltage to drive said LED light source;

controlling a current flowing through an energy storage element according to a driving signal so as to regulate a current flowing through said LED light source;

receiving a first sense signal indicating said current through said LED light source;

generating a saw-tooth signal based on said driving signal; and controlling said driving signal based on signals comprising said saw-tooth signal and said first sense signal to adjust said current through said LED light source to a target level and to correct a power factor of a driving circuit by controlling an average current of said input current to be substantially in phase with said input voltage.

12. The method as claimed in claim 11, further comprising:

receiving a second sense signal indicating said current through said energy storage element; and filtering said second sense signal to generate said first sense signal.

13. The method as claimed in claim 11, further comprising:

generating an error signal indicating a difference between said first sense signal and a reference signal indicating said target current level of said current through said LED light source;

comparing said saw-tooth signal with said error signal;

receiving a detection signal indicating an electric condition of said energy storage element;

switching said driving signal to a first state if said detection signal indicates said current through said energy storage element decreases to a predetermined level;

switching said driving signal to a second state according to a result of said comparison;

increasing said current through said energy storage element when said driving signal is in said first state; and decreasing said current through said energy storage element when said driving signal is in said second state.

14. The method as claimed in claim 13, wherein a time duration for said saw-tooth signal to increase from a predetermined level to said error signal is constant if said current through said LED light source is maintained at said target level.

* * * * *